US010874887B2

(12) United States Patent
Kim et al.

(10) Patent No.: US 10,874,887 B2
(45) Date of Patent: Dec. 29, 2020

(54) CLOCK-TYPE DISASTER PREPAREDNESS KIT

(71) Applicant: KOREA GYEONGGIDO CO., LTD., Gyeonggi-do (KR)

(72) Inventors: Eun A Kim, Gyeonggi-do (KR); Kyung Hun Yim, Gyeonggi-do (KR); Suk Woo Lee, Seoul (KR)

(73) Assignee: KOREA GYEONGGIDO CO., LTD., Gyeonggi-do (KR)

( * ) Notice: Subject to any disclaimer, the term of this patent is extended or adjusted under 35 U.S.C. 154(b) by 169 days.

(21) Appl. No.: 16/133,950

(22) Filed: Sep. 18, 2018

(65) Prior Publication Data

US 2019/0083829 A1 Mar. 21, 2019

(30) Foreign Application Priority Data

Sep. 21, 2017 (KR) ..... 10-2017-0121964

(51) Int. Cl.
*A62B 99/00* (2009.01)
*G04B 47/00* (2006.01)
(Continued)

(52) U.S. Cl.
CPC ..... *A62B 99/00* (2013.01); *B65D 25/10* (2013.01); *G04B 47/00* (2013.01); *G04G 99/00* (2013.01)

(58) Field of Classification Search
CPC ..... B65D 69/00; B65D 77/00; B65D 25/10; B65D 25/102; B65D 25/101; A62B 99/00; G04B 47/00
(Continued)

(56) References Cited

U.S. PATENT DOCUMENTS 5,054,816 A * 10/1991 Rosengarten ..... B42D 3/10 206/472
6,888,496 B1 * 5/2005 Cooper ..... G01S 1/685 342/357.34
(Continued)

FOREIGN PATENT DOCUMENTS

KR 2002773510000 Y1 6/2002

OTHER PUBLICATIONS

How About a Housewarming Gilt Clock Form Disaster Kit Life Clock, Kitchen Interior, Aug. 23, 2017, Naver Blog, South Korea, https://blog.naver.com/heeju001/221080557189.
(Continued)

*Primary Examiner* — Rafael A Ortiz
(74) *Attorney, Agent, or Firm* — Levenfeld Pearlstein, LLC

(57) ABSTRACT

The present invention relates to a clock-type disaster preparedness kit. More particularly, the present invention relates to a clock-type disaster preparedness kit in which a clock is integrated with a configuration for storing disaster preparedness goods such that a location of the disaster preparedness goods is easily recognized whereby it is possible to request rescue promptly in an emergency. Accordingly, the present invention provides the clock-type disaster preparedness kit, the kit including: a housing provided with a storage space in which a first portion and a second portion thereof are engaged with each other; a clock provided on an outer surface of the housing and showing time; a storing portion provided in the second portion of the housing and storing disaster preparedness goods; and a coupling member coupling the first portion and the second portion of the housing to combine the housing.

1 Claim, 4 Drawing Sheets

(51) Int. Cl.
*G04G 99/00* (2010.01)
*B65D 25/10* (2006.01)

(58) Field of Classification Search
USPC ..... 206/223, 541, 1.5; 150/143, 118, 149; 441/80
See application file for complete search history.

(56) References Cited

U.S. PATENT DOCUMENTS

2006/0108241 A1* 5/2006 Smith ..... A62B 99/00 206/223
2006/0266663 A1* 11/2006 Rhea ..... A45C 11/008 206/223
2008/0078682 A1* 4/2008 Clark ..... A62B 99/00 206/223
2013/0306206 A1* 11/2013 Quinnan ..... A45C 13/08 150/105
2014/0090993 A1* 4/2014 Mosley ..... A45C 11/00 206/223

OTHER PUBLICATIONS

Gyeonggi-do Corporation Disaster Kit Life Clock a Decoration Clock for a Sensible Housewarming Gilt, Life/Appliances, Aug. 24, 2017, Naver Blog, South Korea, http://angelinjina.com/221081551809.
How About a Disaster Kit Life Clock as a Housewarming Gift?, Hyon's Lifestyle, Aug. 24, 2017, Naver Blog, South Korea, http://hyonstyle.com/221081561069.
Disaster Kit Life Clock a Must-Have Household Item!!, Etc., Aug. 24, 2017, Naver Blog, South Korea, http://maycool0728.blog.me/221081419395.
Gyeonggi-do Corporation Disaster Kit Life Clock Great for Decoration Clock, Power Review, Aug. 24, 2017, Naver Blog, South Korea, https://blog.naver.com/chyung1505/221081228144.
Get Life Clock Decoration Clock from Gyeonggi-do Corporation, Life Appliances Story, Aug. 25, 2017, Naver Blog, South Korea, https://blog.naver.com/alldct/221082275357.
Recommended! Disaster Kit Clock Gyeonggi-do Corporation, Life Style, Aug. 25, 2017, Naver Blog, South Korea, http://uunih.com/221081639395.
Disaster Kit Gyeonggi-do Corporation Life Clock Housewarming Gift, Lifestyle Interior, Aug. 28, 2017, Naver Blog, South Korea, http://syunibibi.com/221084242618.
Life Clock Disaster Kit a Great Decoration Clock Housewarming Gift~!, Review, Aug. 29, 2017, Naver Blog, South Korea, https://blog.naver.com/cooljh7979/221084403143.
Meet Disaster Kit Life Clock at Gyeonggi-do Corporation, Living, Sep. 6, 2017, Naver Blog, South Korea, https://blog.naver.com/rich0512/221090286136.
Yoo, Hyun Hee, Gyeonggi-do Corporation Launches Disaster Kit 'Life Clock' in Collaboration with 50 Companies, Bridge Economic News, 2017, South Korea, http://www.viva100.com/main/view.php?key=20170809010003265.
Song, Dan Ju, Housewarming Gift Idea Life Clock, IT Life Information Review, Aug. 21, 2017, Naver Blog, South Korea, https://blog.naver.com/PostPrint.nhn?blogId=danjusong&logNo=221078601549.
Disaster Kit Life Clock the Need for a Disaster Kit That Also Works as a Decoration Clock, Prosumer, Aug. 22, 2017, Naver Blog, South Korea, https://blog.naver.com/PostPrint.nhn?blogId=jini809&logNo=221079357918.
Decoration Clock Disaster Kit from Life Clock Gyeonggi-do Corporation, Product Review, Aug. 23, 2017, Naver Blog, South Korea, https://blog.naver.com/lynthia/221080326562.
Innovative Idea from Gyeonggi-do Corporation Disaster Kit Life Clock, Interior, Aug. 24, 2017, Naver Blog, South Korea, https://blog.naver.com/cosmos8952/221081176116.
Prepare a Korean Disaster Kit with Life Clock from Gyeonggi-do Corporation, Etc., Aug. 25, 2017, Naver Blog, South Korea, https://blog.naver.com/megan5026/221081674216.
2-in-1 Housewarming Gift Idea Life Clock Disaster Kit, Living: Interior, Aug. 28, 2017, Naver Blog, South Korea, https://blog.naver.com/cjini86/221083500985.
Great Housewarming Gift a Disaster Kit in the Form of a Clock by Gyeonggi-do Corporation, Home and Living, Aug. 29, 2017, Naver Blog, South Korea, https://blog.naver.com/mokkogi/221084394797.
A Disaster Kit that also Works as a Decoration Clock Essential Household Item!!, Interior, Aug. 30, 2017, Naver Blog, South Korea, https://blog.naver.com/nanahollic/221085305616.
Gyeonggi-do Corporation Life Clock, also Great as Decoration Clock!, LIFE, Aug. 31, 2017, Naver Blog, South Korea, https://blog.naver.com/joye3433ji/221086562067.
Prepare a Disaster Kit with Gyeonggi-do Corporation Life Clock, Moon's Item, Sep. 6, 2017, Naver Blog, South Korea, https://blog.naver.com/onceblue82/221090538527.
Hong, Seok Geun, Taejun Group Becomes the Sole Pharmaceutical Distributor of Korean Disaster Kit 'Lifemet', Financial News, Nov. 17, 2016, South Korea, http://www.fnnews.com/print/201611171135453003.

* cited by examiner

CLOCK-TYPE DISASTER PREPAREDNESS KIT

CROSS REFERENCE TO RELATED APPLICATION

The present application claims priority to Korean Patent Application No. 10-2017-0121964, filed Sep. 21, 2017, the entire contents of which is incorporated herein for all purposes by this reference.

BACKGROUND OF THE INVENTION

Field of the Invention

The present invention relates generally to a clock-type disaster preparedness kit. More particularly, the present invention relates to a clock-type disaster preparedness kit, the kit including disaster preparedness goods with a clock.

Description of the Related Art

In high-rise buildings such as apartments, it is difficult to execute emergency evacuation and rescue activities when disasters such as fire, collapse, earthquake, flood, and tsunami occur, leading to large-scale casualties.

In the event of a fire in a building, most people fail to find emergency staircases or passages due to risks caused by fire, leading to isolation. Furthermore, the visibility is not sufficiently secured at nighttime, which leads to increased casualties.

In particular, in the event of a disaster, the damage greatly increases because people rely on and wait for emergency services such as fire department or 911 rescue team for rescue.

That is, actively coping with disasters by means such as informing a rescue team of the position of people in need of rescue is neglected.

Accordingly, in recent years, individuals retain disaster preparedness goods in preparation for disasters.

For example, individuals prepare disaster preparedness goods by purchasing the products separately and putting the products in a backpack, or preparing a first aid kit with the disaster preparedness goods, or the like.

In addition, there is a released product that provides only disaster preparedness goods.

However, the above-mentioned conventional disaster preparedness goods are hid from everyday life and stored in a separated place such that it is difficult to find the products in emergency.

In other words, disaster preparedness goods are stored in a separate storage box or closet, or stored in a warehouse or other places that are not readily accessible during everyday life. Therefore, in the event of actual disaster, there is a problem that could be difficult to use the disaster preparedness goods properly.

The reason that the disaster preparedness goods are not in an exposed place is that the goods not only lower the efficiency of space utilization but also lower the aesthetic environment of the space, thus the goods are stored in an inconspicuous place and the above-described problems are caused.

DOCUMENTS OF RELATED ART (Non-Patent Document 1) "Taejeon Group exclusively supplies Lifemet which is Korean disaster preparedness kit to pharmacies" in Financial News, Nov. 17, 2016

SUMMARY OF THE INVENTION

Accordingly, the present invention has been made keeping in mind the above problems occurring in the related art, and the present invention is intended to propose a clock-type disaster preparedness kit, in which a clock that is always exposed in everyday life is integrated with a configuration for storing disaster preparedness goods such that the location of the disaster preparedness goods is easily recognized in the event of an emergency whereby a user can use the disaster preparedness goods promptly.

In order to achieve the above object, there is provided a clock-type disaster preparedness kit according to the present invention, the kit including: a housing provided with a storage space in which a first portion and a second portion thereof are engaged with each other; a clock provided on an outer surface of the housing and showing time; a storing portion provided in the second portion of the housing and storing disaster preparedness goods; and a coupling member coupling the first portion and the second portion of the housing to combine the housing.

The storing portion may be provided with a recessed portion in which an upper portion is open, and the disaster preparedness goods provided by being inserted in the recessed portion, and a supporting member may be provided in the storage space of the first portion of the housing, the supporting member supporting the disaster preparedness goods not to escape from the recessed portion.

The supporting member may be provided as an elastic band, and the coupling member may be extended from the elastic band or configured as an integrated body with the elastic band such that the coupling member is provided as a fastening band which is elastic and covers the second portion of the housing.

A stepped portion may be configured on an edge of the second portion of the housing along the edge, and an edge of the first portion of the housing may be configured to be engaged with and mounted on the stepped portion, and a compression-preventing depression may be configured on a portion of the stepped portion that corresponds to the fastening band, the compression-preventing depression preventing the fastening band from being compressed by an edge of the housing while engaging the edges of the first portion and the second portion of the housing with each other.

A clock-type disaster preparedness kit according to the present invention has the following effects.

A configuration for storing disaster preparedness goods is integrated with a clock whereby it is easy to recognize a position where the disaster preparedness kit is located.

Accordingly, in the event of an emergency, it is possible to request rescue promptly because it is easy to recognize where the disaster preparedness goods are located.

In addition, since the clock is always exposed in a space and is utilized for an interior design, there is no disturbance despite the clock being exposed to the space all the time, and the aesthetic is not deteriorated in the interior design.

Accordingly, it is possible to satisfy a user with respect to both the interior and practical aspects.

BRIEF DESCRIPTION OF THE DRAWINGS

The above and other objects, features and other advantages of the present invention will be more clearly understood from the following detailed description when taken in conjunction with the accompanying drawings, in which.

DETAILED DESCRIPTION OF THE INVENTION

Figure 1:
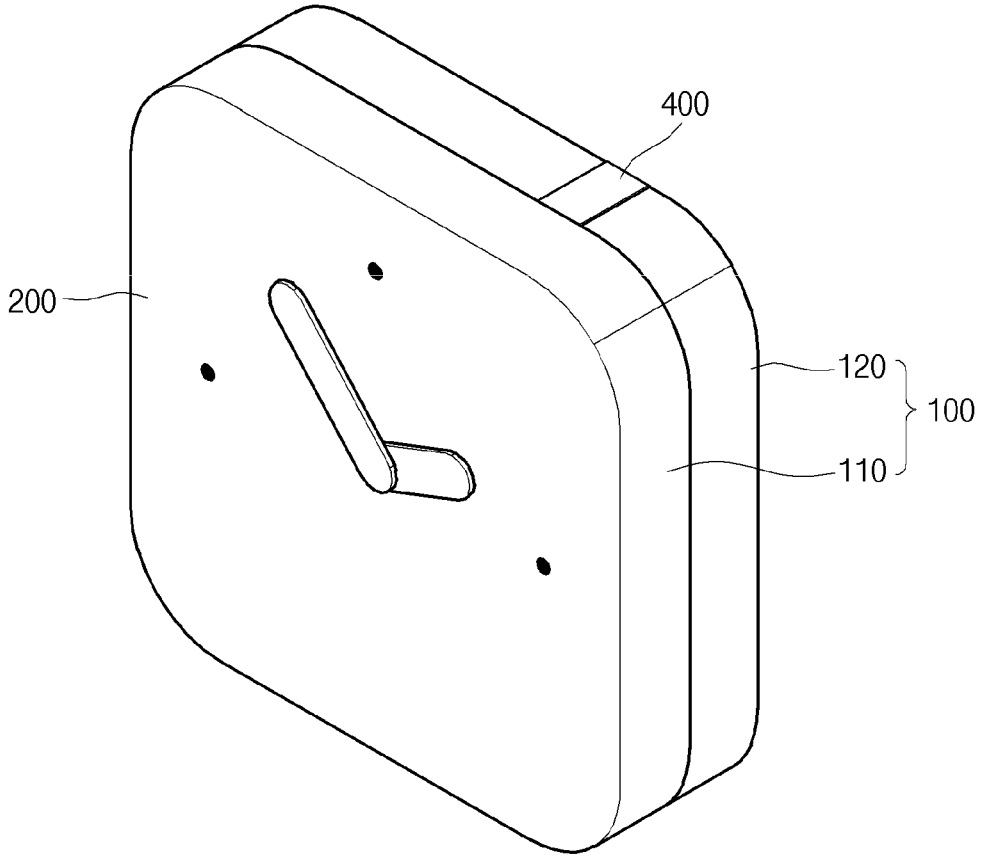
FIG. 1 is a perspective view illustrating a face of a clock-type disaster preparedness kit according to an embodiment of the present invention.

It should be noted that the terms and words used in the specification and the claims should not be construed as being limited to ordinary meanings or dictionary definitions. Meanwhile, the embodiments described in the specification and the configurations illustrated in the drawings are merely examples and do not exhaustively present the technical spirit of the present invention.

Hereinbelow, a clock-type disaster preparedness kit according to an embodiment of the present invention will be described with reference to accompanying drawings, FIGS. 1 to 4.

The clock-type disaster preparedness kit is characterized that it is constructed with a storage box in the clock to accommodate disaster preparedness goods.

Accordingly, the disaster preparedness goods are not only exposed in everyday life but are easily recognizable from a conspicuous place such that it is possible to promptly make a disaster relief request in case of an emergency.

Figure 2:
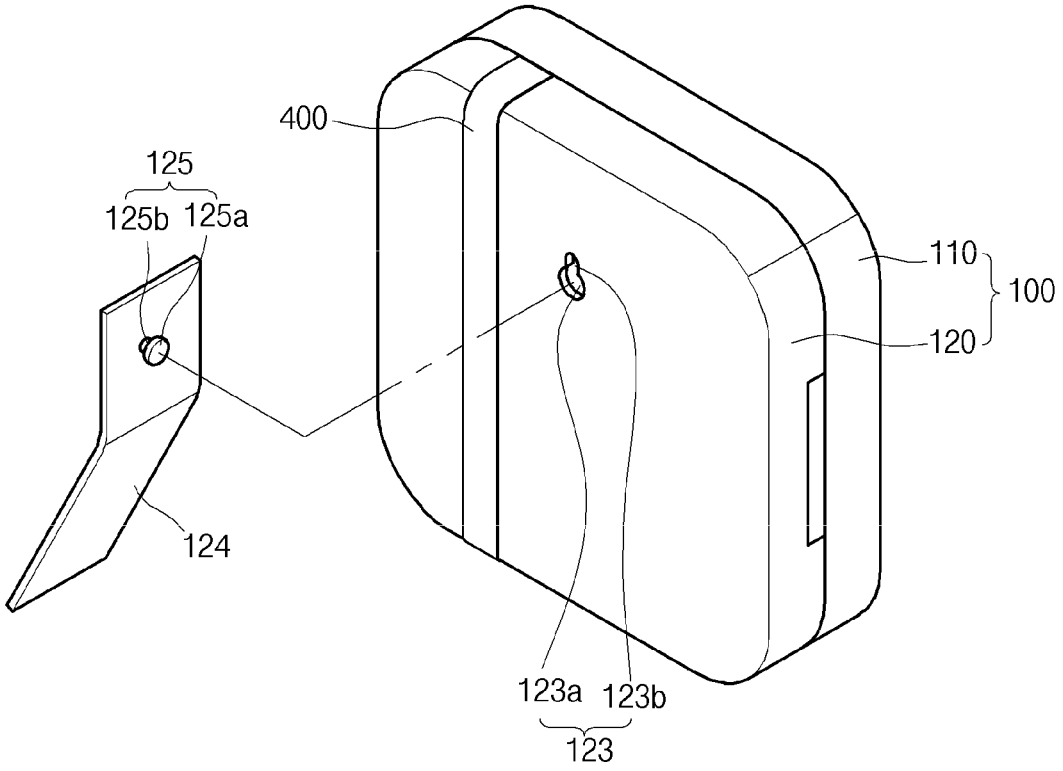
FIG. 2 is an exploded perspective view illustrating a rear of the clock-type disaster preparedness kit according to the embodiment of the present invention.
Figure 3:
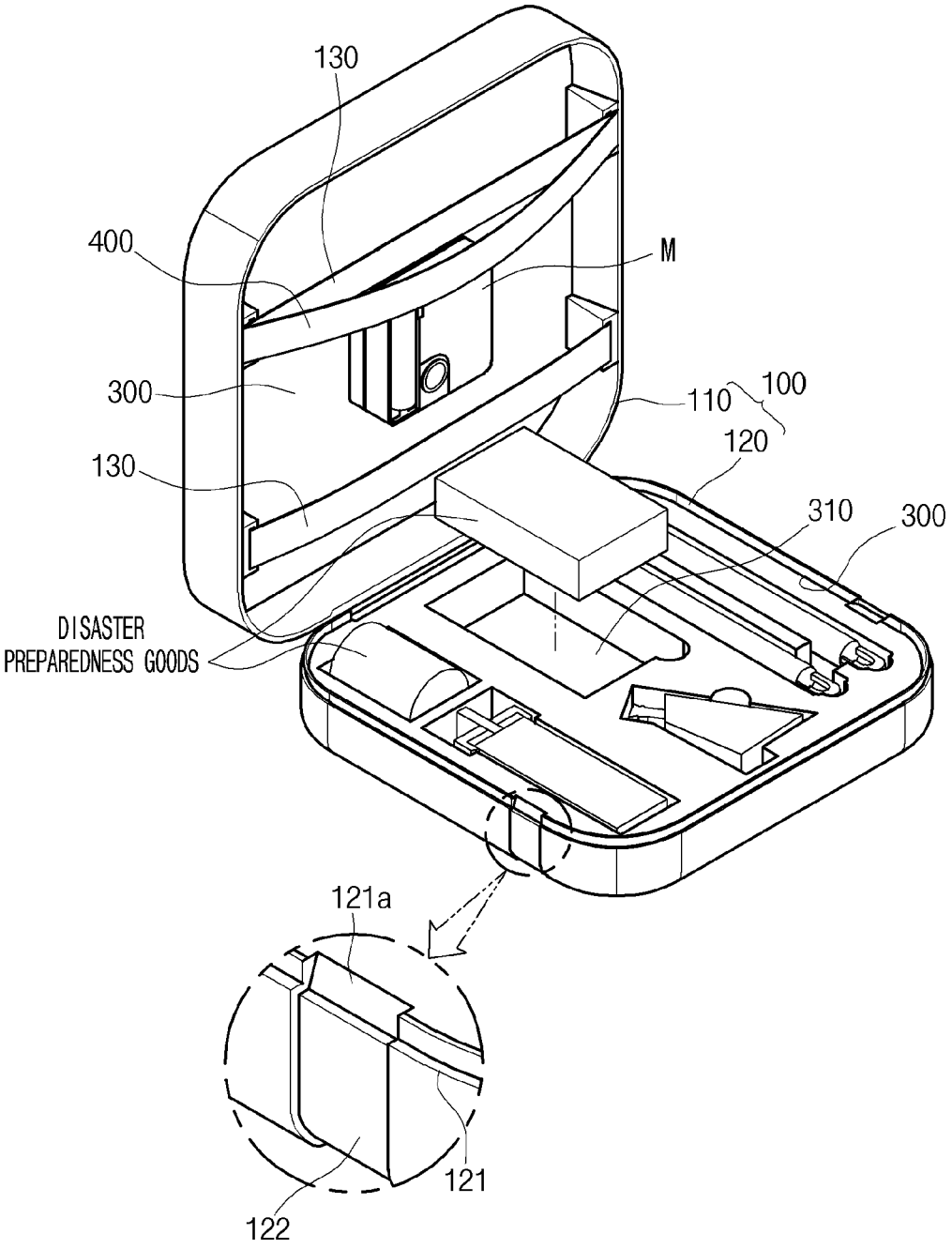
FIG. 3 is a perspective view illustrating the inside of the clock-type disaster preparedness kit according to the embodiment of the present invention is opened.

As shown in FIGS. 1 to 3, the clock-type disaster preparedness kit includes a housing 100, a clock 200, a storing portion 300, and a coupling member 400.

The housing 100 constitutes an appearance of the clock-type disaster preparedness kit, and may be aesthetically designed in various shapes and colors.

In this description, a quadrangle housing 100 will be described as an example to aid understanding the description.

The housing 100 constitutes a storage space, and is configured as a first portion and a second portion in a separated manner.

That is, the housing 100 is opened such that the disaster preparedness goods and a movement M of the clock are positioned and stored.

Here, the first portion of the housing 100 is referred to as a first body 110 and the second portion of the housing 100 is referred to as a second body 120, for convenience of explanation.

The first body 110 serves as the face of the housing 100, and the second body 120 serves as the rear of the housing 100.

With respect to the housing 100, it is preferable that an end portion of the first body 110 and an end portion of the second body 120 are hinged to each other.

It is also possible that the first body 110 and the second body 120 are provided separately. However, as the first body 110 and the second body 120 are provided to be rotatable around the hinge, it is possible to prevent loss of the housing 100 and to open and close the housing 100 easily.

Meanwhile, the first body 110 and the second body 120 are configured with individual storage spaces. The first body 110 and the second body 120 are engaged with each other and then coupled with each other by a coupling member 400 which will be described later.

Here, the first body 110 and the second body 120 are configured to be engaged with each other at edges thereof.

For the above-mentioned configuration, the second body 120 is configured with a stepped portion 121 provided along the edge of the storage space and stepped toward the storage space from an outer side surface of the second body 120.

With the configuration, the edge of the first body 110 is mounted on the stepped portion 121 of the second body 120 such that the first body 110 and the second body 120 are engaged with each other.

In addition, as shown in FIG. 3, the storage space of the first body 110 is mounted with a supporting member 130.

The supporting member 130 serves to prevent the disaster preparedness goods prepared in the storage space of the second body 120 from escaping from the storage space, and is provided across the storage space of the first body 110.

It is preferable that the supporting member 130 is provided as an elastic band having elasticity. In addition, it is preferable that multiple supporting members 130 are provided on the storage space of the first body 110.

In addition, the stepped portion 121 of the second body 120 is provided with a compression-preventing depression 121*a*.

The compression-preventing depression 121*a* is to prevent a fastening band, which is the coupling member 400 and will be described later, from being compressed by the first body 110 and the second body 120 while engaging the first body 110 and the second body 120, and the compression-preventing depression is configured in a depressed shape on the stepped portion 121.

With the configuration of the compression-preventing depression 121*a*, it is possible to prevent the fastening band which is the coupling member 400 from being damaged.

Figure 4:
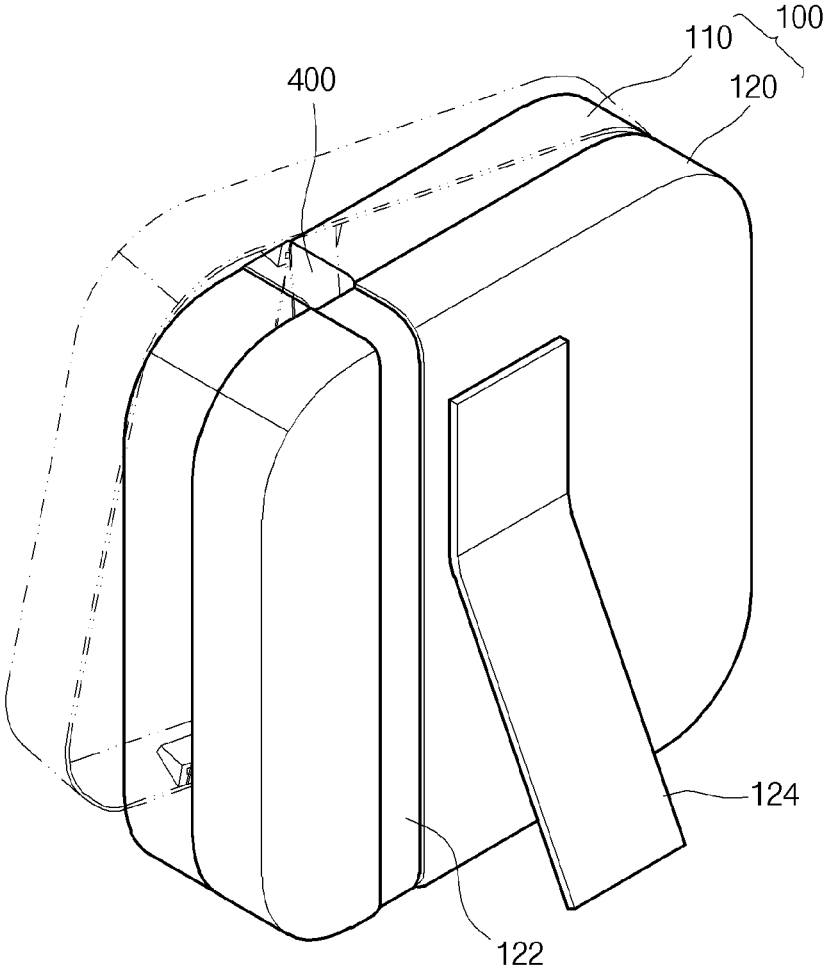
FIG. 4 is a perspective view illustrating the rear of the clock-type disaster preparedness kit.

In addition, as shown in FIG. 4, the outer side surface of the second body 120 is provided with an immobilizing depression 122.

The immobilizing depression 122 is to immobilize the fastening band 400 from the second body 120 when the fastening band 400 covers the second body 120 to engage the first body 110 and the second body 120 together. The immobilizing depression 122 is configured in a shape corresponding to the fastening band 400 at the outer side surface of the second body 120.

A depressed depth of the immobilizing depression 122 corresponds to the thickness of the fastening band 400, and the immobilizing depression 122 is configured such that the fastening band 400 does not easily escape from the immobilizing depression 122.

Meanwhile, as shown in FIG. 2, an outer surface of the second body 120 is configured with a hanging hole 123 and provided with a pedestal 124 which is detachable at the hanging hole 123.

The configuration is intended to allow the clock-type disaster preparedness kit to be supported on a wall or a tabletop.

For example, when the pedestal 124 is detached from the hanging hole 123, the clock-type disaster preparedness kit can be used as a wall clock by hanging from the hanging hole 123 on a wall nail and the like. On the other hand, when the pedestal 124 is coupled to the hanging hole 123, the pedestal 124 can be supported on a tabletop to be used as a table clock.

As shown in FIG. 2, the hanging hole 123 is configured with a guiding hole 123*a* and a jam hole 123*b*.

The guiding hole 123*a* is configured to be greater than the jam hole 123*b* in diameter.

With the configuration, a head of a nail, and the like fixed on a wall is guided by the guiding hole 123*a* and a body of the nail is jammed in the jam hole 123*b* whereby it is easy to hang the kit on the wall.

In addition, the pedestal 124 is provided with a protrusion 125. The protrusion 125 is provided with an inserted portion 125*a* having a diameter corresponding to the diameter of the guiding hole 123*a* and a supporting portion 125*b* having a diameter corresponding to the diameter of the jam hole 123*b*.

With the configuration, the inserted portion 125*a* of the pedestal 124 is inserted in the guiding hole 123*a*, and the supporting portion 125*b* is risen up to the jam hole 123*b* such that the pedestal 124 is coupled to the second body 120.

The clock 200 shows time and is disposed on an outer surface of the first body 110.

The clock 200 may be provided as a digital clock or an analog clock. In the present description, the clock 200 is exemplified by an analog clock with hands.

The storing portion 300 is configured to store the disaster preparedness goods, and provided in the storage space of the second body 120.

Since the second body 120 is provided in the second body 120 as described above, when opening the housing 100, it is possible to prevent the disaster preparedness goods stored in the storing portion 300 from escaping from the housing 100.

Because it is common to rotate the first body 110 after the clock 200 provided on the first body 110 faces upward when opening the housing 100, it is possible to prevent the disaster preparedness goods from escaping from the storing portion 300.

If the storing portion 300 is provided in the storage space of the first body 110, the disaster preparedness goods may escape from the storing portion 300 when rotating the first body 110 with the clock 200 facing upward. Accordingly, it is preferable that the storing portion 300 is provided in the second body 120.

Meanwhile, as shown in FIG. 3, the storing portion 300 stores various kinds of disaster preparedness goods, and is configured with a recessed portion 310 for storing the disaster preparedness goods.

The storing portion 300 is supported by an elastic band 130 such that the disaster preparedness goods do not escape from the recessed portion 310.

That is, when the first body 110 and the second body 120 are coupled with each other, the elastic band 130 supports the disaster preparedness goods of the storing portion 300 elastically such that despite the housing 100 is turned over, the disaster preparedness goods are not disturbed when opening the housing 100.

The coupling member 400 serves to couple the separated housing 100.

As described above, the housing 100 is provided in which the end portion of the first body 110 and the end portion of the second body 120 are hinged to each other. Accordingly, the coupling member 400 serves to couple a remaining end of the first body 110 and a remaining end of the second body 120 such that the first body 110 and the second body 120 are not separated from each other.

The coupling member 400 may be provided in various forms such as a hook, a magnet, and the like. In the description, the coupling member 400 is provided as a band.

The fastening band provided as the coupling member 400 may be fixed to both ends of the elastic band 130 as shown in FIG. 3 or integrally configured at opposite ends of the elastic band 130.

With this configuration, the fastening band 400 is provided in an integrated ring with the elastic band 130. When coupling the first body 110 and the second body 120 to each other, the coupling band 400 is extended to cover the outer surface of the second body 120 as shown in FIG. 2 whereby the first body 110 and the second body 120 are coupled to each other.

That is, the fastening band 400 provided on the first portion of the housing 100 covers the second portion of the housing 100 such that the housing 100 is engaged.

Hereinbelow, the use of the clock-type disaster preparedness kit having the above-described configuration will be described.

As shown in FIG. 3, the recessed portion 310 of the storing portion 300 stores the disaster preparedness goods.

Here, examples of the disaster preparedness goods include a glow stick for securing sight and a rescue request, an emergency rescue blanket for maintaining body temperature, a whistle for notifying of a position, a flag for requesting rescue, a compression bandage for first aid, and the like. The disaster preparedness goods are provided by being inserted in the recessed portion 310 of the storing portion 300.

After storing the disaster preparedness goods, the first body 110 is rotated to close the storage space of the housing 100 as shown in FIG. 4.

At this point, the fastening band 400 is exposed from the storage space of the first body 110 and hung on the outer surface of the first body 110.

Then, the fastening band 400 hung on the first body 110 is extended to cover the outer surface of the second body 120.

As shown in FIG. 2, the fastening band 400 is partly transferred on the outer surface of the second body 120.

Since the fastening band 400 provided on the first body 110 covers the second body 120, the housing 100 is engaged.

Then, the engaged housing 100 is disposed in indoor space with the clock 200 as a front and used as a clock.

Here, the housing 100 may be provided with various colors and designs and disposed at a conspicuous place in indoor space.

Meanwhile, in the event of an emergency, a user can easily find the clock-type disaster preparedness kit, open the housing 100 by unwinding the fastening band 400, and then request rescue using the disaster preparedness goods.

It is possible to carry out the processes promptly, and also request the rescue promptly.

As described above, the clock-type disaster preparedness kit according to the present invention is characterized in that the disaster preparedness goods are provided in the storage space inside the clock.

In other words, the disaster preparedness goods are provided in the clock that are always placed in a conspicuous place such that the disaster preparedness goods can be easily recognized and found in the event of an emergency.

Thus, the rescue request can be made promptly.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A clock-type disaster preparedness kit, the kit comprising:

a housing provided with a storage space in which a first portion and a second portion thereof are engaged with each other;

a clock provided on an outer surface of the housing and showing time;

a storing portion provided in the second portion of the housing and storing disaster preparedness goods;

a coupling member coupling the first portion and the second portion of the housing to combine the housing; wherein the storing portion is provided with a recessed portion in which an upper portion is open, and the disaster preparedness goods provided by being inserted in the recessed portion, and a supporting member is provided in the storage space of the first portion of the housing, the supporting member supporting the disaster preparedness goods not to escape from the recessed portion; wherein the supporting member is provided as an elastic band, and the coupling member is extended from the elastic band or configured as an integrated body with the elastic band such that the coupling member is provided as the fastening band which is elastic and covers the second portion of the housing and wherein a stepped portion is configured on an edge of the second portion of the housing along the edge, and an edge of the first portion of the housing is configured to be engaged with and mounted on the stepped portion, and a compression-preventing depression is configured on a portion of the stepped portion that corresponds to the fastening band, the compression-preventing depression preventing the fastening band from being compressed by an edge of the housing while engaging the edges of the first portion and the second portion of the housing with each other.

* * * * *